United States Patent [19]

Hatch et al.

[11] Patent Number: 5,027,622

[45] Date of Patent: Jul. 2, 1991

[54] LOCKING DEVICE FOR RODS EXTENDING FROM MERCHANDIZING DISPLAYS

[76] Inventors: J. Mel Hatch, 4850 So. Hidden Cove Circle, Murray, Utah 84123; Lonnie DeGooyer, 349 East 5600 South, Murray, Utah 84107

[21] Appl. No.: 548,564

[22] Filed: Jul. 5, 1990

[51] Int. Cl.[5] ..... E05B 73/00

[52] U.S. Cl. ..... 70/14; 70/58; 70/161; 211/7; 211/59.1

[58] Field of Search ..... 70/57, 58, 14, 61, 62, 70/159 ∝ 162; 211/7, 57.1, 59.1

[56] References Cited

U.S. PATENT DOCUMENTS

| | | | |
|---|---|---|---|
| 1,386,543 | 8/1921 | Tiller | 70/14 |
| 3,007,331 | 11/1961 | Irwin | 70/57 |
| 3,785,501 | 1/1974 | Canning | 211/7 |
| 4,289,242 | 9/1981 | Kenyon | 211/59.1 X |
| 4,299,361 | 11/1981 | Webb | 70/57 X |
| 4,462,497 | 7/1984 | Maule | 211/7 |

FOREIGN PATENT DOCUMENTS

| | | | |
|---|---|---|---|
| 2608807 | 9/1977 | Fed. Rep. of Germany | 70/58 |
| 1050698 | 9/1953 | France | 70/58 |
| 2580243 | 10/1986 | France | 70/252 |

*Primary Examiner*—Lloyd A. Gall

*Attorney, Agent, or Firm*—Terry M. Crellin

[57] ABSTRACT

A locking device for attaching to a rod extending from a merchandizing display. The locking device comprises a block having an elongate slot formed therein. The slot has end openings at the ends of the block and an elongate side opening along one side of the block, whereby the elongate portion of a rod on the merchandizing display can be received longitudinally within the slot through the side opening in the side of the block. Cover means are provided for covering and closing the side opening of the slot in the one side of the block, whereby when the rod is received in the slot, the block can slide back and forth along the rod but cannot be removed from the bent end of the rod. A locking mechanism is also provided for releasable locking the cover in place covering and closing the opening of the slot.

6 Claims, 1 Drawing Sheet

LOCKING DEVICE FOR RODS EXTENDING FROM MERCHANDIZING DISPLAYS

BACKGROUND OF THE INVENTION

1. Field of the Invention

The present invention relates to pegboard type racks for displaying merchandise and more particularly to improved locking devices for attaching to the pegs for securely holding merchandise on the pegs until the locking device is released by a sales clerk.

2. State of the Art

It is well known to display merchandise by placing the merchandise on cards that are hung on pegs or rods extending outwardly from a pegboard. Displaying of merchandise in such a manner is desirable in that it enables the customer to observe the merchandise and select from items of interest prior to actually purchasing the item. However, merchandise so displayed is subject to pilfering, and store owners have had to avoid such displays with shoplift prone items.

A search of the prior art found that there had been many attempts at modifying pegboard display racks to reducing the pilfering of merchandise therefrom. Various elaborate schemes for securing merchandise to a display rack are shown in U.S. Pat. Nos. 3,211,408; 3,481,482; 3,827,569; 3,850,300; 3,934,727; 4,026,415; and 4,474,300. In addition, a device for locking a helmet to a bar of a motorcycle or bicycle is shown in U.S. Pat. No. 4,274,271, and a device for locking to the prongs of electrical plugs is shown in U.S. Pat. No. 2,733,416. A device for locking a pair of snow skis together is shown in U.S. Pat. No. 3,999,409.

The prior art fails to show a simple locking device that can be attached to the peg or rod to prevent removal of an item from a pegboard type display. It would be highly desirable to have such a simple locking device that can quickly be unlocked by the clerk to remove an item from the peg or rod when it is to be sold, with the locking device readily relocked on the peg or rod to deter unwanted pilfering of items from the peg or rod.

3. Objectives

A principal objective of the invention is therefore to provide a simple, relatively inexpensive locking device that can be attached to a single peg or rod of a pegboard type display to prevent unwanted removal of an item from the peg or rod.

A particular objective of the present invention is to provide such a locking device that can be quickly and easily removed from the peg or rod by a sales clerk when an item is to be sold and then just as quickly and easily replaced on the peg or rod to deter pilfering of items from the peg or rod when the clerk is not present.

BRIEF DESCRIPTION OF THE INVENTION

The above objectives are achieved in accordance with the present invention by providing a novel locking device for attaching to an individual peg or rod extending from a merchandizing display rack of the pegboard type. The present invention in particular pertains to such a display system in which the peg or rod comprises an elongate portion extending from the display rack and a free end portion which is bent at an angle to the elongate portion of the peg or rod.

The locking device of the present invention comprises a block having an elongate slot formed therein. The slot has opposite ends opening at the side ends of the block and an elongate side which is open along its length along one side of the block. The block is easily placed on the rod or peg of the display rack, with the elongate portion of the rod or peg being received longitudinally within the slot through the side opening of the slot in the side of the block.

A removable cover is provided for covering and closing the side opening of the slot in the one side of the block when the rod or peg is received in the slot, whereby the block can slide back and forth along the rod or peg but cannot be removed from the bent end of the rod. A releasable locking mechanism is provided for retaining the cover in place covering and closing the opening of the slot.

When an item is to be removed from the rod or peg, a sales clerk can quickly unlock the cover and remove the block from the rod or peg. Following removal of an item from the rod or peg, the clerk then replaces and relocks the block on the rod or peg to prevent pilfering of items from the rod or peg.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which.

DETAILED DESCRIPTION OF THE ILLUSTRATED EMBODIMENTS

Figure 1:
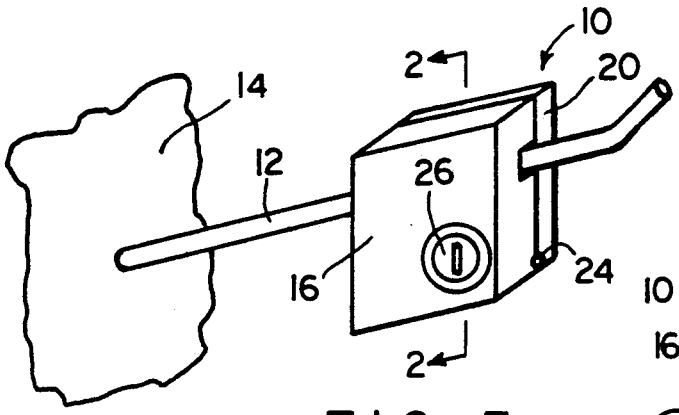
FIG. 1 is a pictorial representation of a portion of a display rack showing an elongate rod extending therefrom, with a locking device of the present invention attached to the rod.
Figure 2:
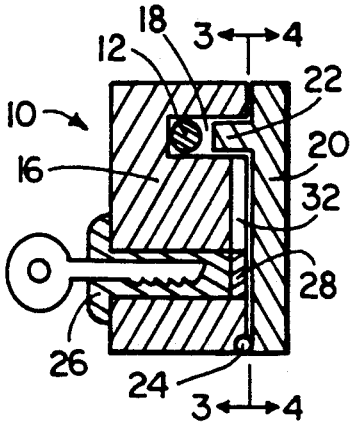
FIG. 2 is cross section through the locking device and the rod taken along line 2—2 of FIG. 1.
Figure 3:
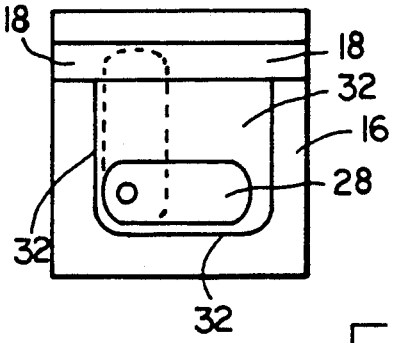
FIG. 3 is an elevation view of the broad face of the block forming the locking device as taken along line 3—3 of FIG. 2.
Figure 5:
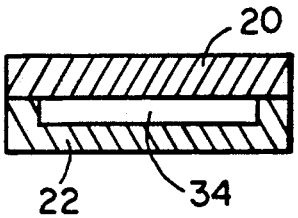
FIG. 5 is a cross section through the cap plate taken along line 5—5 of FIG. 4.
Figure 4:
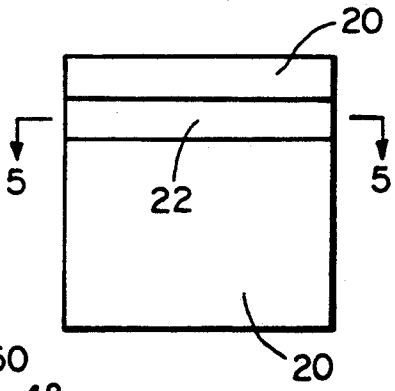
FIG. 4 is an elevation view of the face of the cap plate that closes upon the broad face of the block of the locking device, with the view being taken on line 4—4 of FIG. 2.

Referring to the drawings, there is shown a locking device 10 that is received on the elongate rod 12 of a merchandizing pegboard 14 (FIG. 1). The rod 12 extends from the pegboard 14, with the free end of the rod 12 being bent at an angle to the elongate portion of the rod as is customary with such displays. The bent free end of the rod 12 is customarily provided to aid in retaining items received on the rod 12, but does not, of course, prevent a shoplifter from pilfering items from the display.

The locking device 10 of the present invention fits around the rod 12 so as to be slidable along the rod. The rod 12 is received in an elongate slot or channel formed through the device 10, with the slot through the device being dimensioned such that the device 10 cannot be slid over the bent end of the rod 12. To remove the device 10 from the rod 12, it must be opened so that the slot therein is exposed along a longitudinally side thereof. The device 10 is then removed from the rod 12 by allowing the rod 12 to exit the device 10 through the open side of the slot. Once the device 10 has been removed by a store clerk or other authorized person, sales items can be removed from the rod 12 for sales. The device 10 is then replaced on the rod 12 by the clerk to prevent shoplifting of the sales items from the display when the clerk is engaged in another activity.

As shown in FIGS. 1–5 of the drawings, one preferred embodiment of the device comprises a block 16 having an elongate slot 18 formed inwardly along one of the broad faces of the block 16 so that the longitudinal side of the slot 18 opens to the broad face of the block 16, and the ends of the slot 18 open at the opposite side ends of the block 16. The slot 18 has a width which is just slightly oversized of the rod 12, such that the rod can be received longitudinally in the open side of the slot 18 in the broad face of the block 16.

In the embodiment shown in FIGS. 1–5 of the drawings, the slot 18 has a depth extending inwardly from the broad face of the block 16, with the depth being equivalent to two or more diameters of the rod 12. A cover plate 20 is provided for covering the broad face of the block 16 and closing the side opening of the slot 18 in the broad face of the block 16. When the device 10 is attached to the rod 12, the rod is received longitudinally in the slot 18, with the cover plate 20 withdrawn from the broad face of the block 16. The cover plate 20 is then placed over the broad face of the block 16 to retain the rod 12 in the slot 18.

The block 16 can slide back and forth along the rod 12 but cannot be removed from the bent end of the rod 12. In the embodiment shown in FIGS. 1–5 of the drawings, the cover plate 20 has a keeper bar 22 that extends from the side of the cover plate 20 and is received into the side opening of the slot 18. One of the functions of the keeper bar 22 is to limit the size of the passage in the slot that receives the rod 12. By limiting the passage to be just slightly larger than the rod 12, and by making the longitudinal length of the slot 18 at least about an inch to an inch and a half or greater, the device 10 cannot be slid over the bent end of the rod 12 when the cover plate 20 is in its closed position abutting the broad face of the block 16.

The keeper bar 22 has a second function of cooperating with a lock element to retain the cover plate 20 in its closed position. As illustrated, the cover plate 20 is preferably connected through a hinge along one of its sides to a side edge of the block 16, so that the cover plate can pivot about the hinge axis 24. The cover plate 20 can pivot from the closed position to an open position extending obliquely from the broad face of the block 16 to expose the open longitudinal side of the slot 18.

The keeper bar 22 on the cover plate 20 cooperates with a locking mechanism to lock the cover plate 20 in its closed position. As illustrated, the locking mechanism comprises a key activated lock 26 imbedded in the block 16. The lock 26 operates a latch comprising a substantially flat, elongate member 28 that is turned by the key in the lock 26 about a pivot point adjacent to one of the ends of the latch member 28. The latch member 28 is positioned in a recessed area 32 in the broad face of the block 16 and can pivot from an unlocked position in which the latch member lies substantially parallel to the slot 18 to a locked position in which, as shown by dashed lines in FIG. 3, the latch member extends normal to the slot 18, with the free end of the latch member 28 extending into the slot 18. When the cover plate 20 is pivoted to its closed position and the latch member 28 is moved to its locked position, the latch member 28 engages a slotted opening 34 in the keeper bar 22 to retain the cover plate in its closed, locked position.

Figure 6:
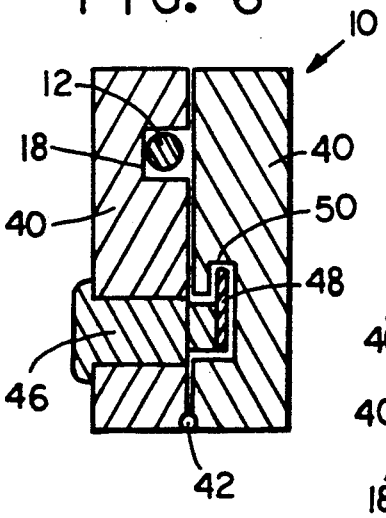
FIG. 6 is a vertical section through a modified embodiment of a locking device in accordance with the present invention.
Figure 7:
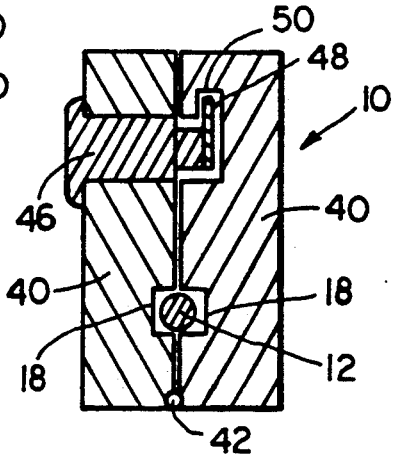
FIG. 7 is a vertical section through another modified embodiment of a locking device in accordance with the present invention.

It should be realized that the slot 18 need not be as deep as that described above with respect to the embodiment shown in FIGS. 1–5. Nor does the keeper element that cooperates with the key lock have to be a bar that is received within the slot 18. Referring to FIGS. 6 and 7, there are shown two alternate, preferred embodiments of the device 10 of the present invention. In the alternate embodiments, the slot 18 has both a width and depth which are only slightly oversized of the rod 12. That is the width and depth of the slot 18 of the embodiments shown in FIGS. 6 and 7 are just slightly greater than the diameter of the rod 12.

In the embodiments shown in FIGS. 6 and 7, the device 10 comprises two blocks 40 hingedly attached to each other about a hinge axis 42 positioned along respective side edges of the blocks 40. The blocks 40 can pivot from an open position extending obliquely from each other to a closed position in which the opposite, broad sides or faces of the blocks 40 are juxtaposed.

In the embodiment shown in FIG. 6, an elongate slot 18 is formed in one of the juxtaposed sides of the two blocks 40, with the slot 18 having end openings at the side ends of the blocks 40. Like the slot 18 of the previously described embodiment of FIGS. 1–5, the slot 18 in the embodiment of FIG. 6 has an elongate side opening along the broad face of one of the blocks 40 that is juxtaposed adjacent to the other block 40. The elongate portion of the rod 12 is received longitudinally within the slot 18 through the side opening of the slot 18 when the blocks 40 are pivoted to their open position. The rod 12 remains in the slot 18 when the blocks 40 are pivoted to their closed position, and the blocks 40 can slide back and forth along the rod 12 but cannot be removed from the bent end of the rod.

In the embodiment shown in FIG. 7, complimentary slots are formed in each of the juxtaposed sides or faces of the two blocks. The complimentary slots open to each other and meet in longitudinal alignment to form the composite slot 18 in which the rod 12 is received when the blocks 40 are pivoted to their closed position. In the closed position, the blocks 40 of the embodiment shown in FIG. 7 can slide back and forth along the rod 12 but cannot be removed from the bent end of the rod.

Means are provided for releasably locking the blocks 40 of the embodiments of FIGS. 6 and 7 in their closed positions. The locking mechanism preferably comprises a key activated lock 46 similar to the lock 26 of the embodiment of the device 10 shown in FIGS. 1–5. The lock 46 is imbedded in one of the blocks 40 and operates a latch member 48 that is turned by the key in the lock 46 so that the latch member 48 is movable into and out of engagement with a keeper notch 50 in the opposing block 40.

As shown in FIGS. 6 and 7, the relative positions of the locking means and the slot 18 can be interchanged. The slot 18 can be positioned near the free ends of the blocks 40, in which case the locking means is located between the slot 18 and the hinge axis 42. When the locking means is positioned near the free ends of the blocks 40, the slot 18 is located between the locking means and the hinge axis 42.

Although preferred embodiments of the locking device 12 of the present invention have been illustrated and described, it is to be understood that the present disclosure is made by way of example and that various other embodiments are possible without departing from the subject matter coming within the scope of the following claims, which subject matter is regarded as the invention.

We claim:

1. A locking device for attaching to a rod extending from a merchandizing display, wherein the rod comprises an elongate portion extending from the display and s free end portion which is bent at an angle to the elongate portion of the rod, said locking device comprising a block having an elongate slot formed therein, with the slot having end openings at the ends of the block and an elongate side opening along one side of the block, whereby the elongate portion of said rod can be received longitudinally within said slot through said side opening in the side of the block;

cover means for covering and closing the side opening of the slot in the one side of said block when said rod is received in said slot;

said slot having a width and depth which are oversized of the rod, whereby when said rod is received in said slot and said slot is covered by said cover means, said block can slide back and forth along said rod but cannot be removed from the bent end of said rod; and means for releasable locking said cover means in place covering and closing the opening of said slot, whereby a sales clerk can quickly unlock the cover means and remove the block from the rod for removal of a sales item for the rod and then replace and relock the block on the rod to prevent unintended removal of sales items for the rod.

2. A locking device in accordance with claim 1 wherein the cover mean comprises a cover plate which is hingedly connected to the one side of said block to swing from a locked, closed position covering and closing the side opening of said slot to an unlocked, open position extending away for the side of said block to expose the side opening of said slot.

3. A locking device in accordance with claim 2 wherein the means for releasably locking the cover plate in its locked, closed position comprises a key activated lock imbedded in said block, with said lock having a latch that engages a keeper on said cover plate and retains the cover plate in its closed position.

4. A locking device for attaching to a rod extending from a merchandizing display, wherein the rod comprises an elongate portion extending from the display and as free end portion which is bent at an angle to the elongate portion of the rod, said locking device comprising a block having an elongate slot formed therein, wit the slot having end openings at the ends of the block and an elongate side opening along one side of the block, whereby the elongate portion of said rod can be received longitudinally within said slot through said side opening in the side of the block;

cover means for covering and closing the side opening of the slot in the one side of said block when said rod is received in said slot, whereby said block can slide back and forth along said rod but cannot be removed for the bent end of said rod;

said cover means comprising a cover plate which is hingedly connected to the one side of said block to swing from a locked, closed position covering and closing the side opening of said slot to an unlocked, open position extending away from the side of said block to expose the side opening of said slot;

means for releasable locking said cover means in place covering and closing he opening of said slot, said means for releasably locking the cover plate in its locked, closed position comprising a key activated lock imbedded in said block, with said lock having a latch that engages a keeper on said cover plate and retains the cover plate in its closed position;

said latch is a substantially flat, elongate member that is turned by the lock about a pivot point adjacent one of the ends of the latch;

the latch is located in a recessed area on the one side of said block; and said keeper comprises an elongate lip extending from said cover plate to project into said slot when the cover plate is in its closed position, with a central slotted opening being provided in said lip, whereby the latch engages said slotted opening to retain the cover plate in its closed position, whereby a sales clerk can quickly unlock the cover means and remove the block from the rod for removal of a sales item from the rod and then replace and relock the block on the rod to prevent unintended removal of sales items for thread.

5. A locking device for attaching to a rod extending from a merchandizing display, wherein the rod comprises an elongate portion extending from the display and a free end portion which is bent at an angle to the elongate portion of the rod, said locking device comprising two blocks hingedly attached along respective side edges such that the block pivot from an open positions extending obliquely from each other to a closed position in which the opposite, board, sides of said blocks are juxtaposed;

an elongate slot formed in at least one of the juxtaposed sides of the two blocks, with the slot having end openings at the ends of the blocks and an elongate side opening along at least one of the juxtaposed sides of said blocks, said slot further having a width and depth which are oversized of the rod, whereby the elongate portion of said rod can be received longitudinally within said slot through said side opening when the blocks are pivoted to their open position and remain in said slot when the blocks are pivoted to their closed position, such that said block can slide back and forth along aid rod but cannot be removed from the bent end of said rod; and means for releasable locking said blocks in their closed position;

whereby a sales clerk can quickly unlock the blocks and remove the blocks from the rod for removal of a sales item from the rod and then replace and relock the blocks on the rod to prevent unintended removal of said items for the rod.

6. A locking device in accordance with claim 5, wherein an elongate groove is cut in each of the juxtaposed sides of the two blocks, with the two grooves being in alignment with each other to form said slot when the blocks are in their closed position.

* * * * *